US006925785B1

(12) United States Patent
Kawasaki

(10) Patent No.: US 6,925,785 B1
(45) Date of Patent: Aug. 9, 2005

(54) BEAR-RESISTANT PANNIER

(76) Inventor: Jerry R. Kawasaki, P.O. Box 38, Gallatin Gateway, MT (US) 59730

( * ) Notice: Subject to any disclaimer, the term of this patent is extended or adjusted under 35 U.S.C. 154(b) by 52 days.

(21) Appl. No.: 10/712,980

(22) Filed: Nov. 13, 2003

Related U.S. Application Data

(60) Provisional application No. 60/425,909, filed on Nov. 13, 2002.

(51) Int. Cl.[7] ..... B68C 1/02; E05C 5/02

(52) U.S. Cl. ..... 54/37.1; 292/57

(58) Field of Search ..... 54/37.1; 220/200, 220/241, 242, 243, 244, 246, 250; 292/5, 6, 11, 30, 57, 60, 63, 71, 86

(56) References Cited

U.S. PATENT DOCUMENTS

| | | | | | |
|---|---|---|---|---|---|
| 37,742 | A | * | 2/1863 | Dunton | 54/37.1 |
| 1,059,240 | A | * | 9/1913 | Walker | 54/37.1 |
| 1,200,311 | A | * | 10/1916 | Cash et al. | 220/246 |
| 1,517,677 | A | * | 12/1924 | Heinkel | 220/243 |
| 1,904,291 | A | * | 4/1933 | Neilson et al. | 292/5 |
| 3,627,365 | A | | 12/1971 | Mace | |
| 3,871,523 | A | | 3/1975 | Bassett | |
| 3,929,360 | A | | 12/1975 | Gulistan | |
| 4,136,898 | A | * | 1/1979 | Guenther | 292/57 |
| 4,179,038 | A | * | 12/1979 | Rosan, Jr. | 220/243 |
| D304,008 | S | | 10/1989 | Hornung | |
| 5,165,738 | A | | 11/1992 | McCormack | |
| 5,584,514 | A | * | 12/1996 | Mascotte | 292/57 |
| 5,975,593 | A | * | 11/1999 | Cress | 292/86 |
| 6,059,135 | A | * | 5/2000 | James et al. | 220/244 |
| 6,224,118 | B1 | | 5/2001 | Ashford | |
| 6,550,824 | B1 | * | 4/2003 | Ramsauer | 292/11 |
| 6,568,226 | B1 | | 5/2003 | Ramsauer | |

* cited by examiner

*Primary Examiner*—Teri Pham Luu
*Assistant Examiner*—Elizabeth Shaw
(74) *Attorney, Agent, or Firm*—Richard C. Conover

(57) ABSTRACT

A bear-resistant pannier including an open top pannier preferably constructed of metal with a recessed cover for covering the open top. A spring loaded latch selectively secures the pannier.

5 Claims, 6 Drawing Sheets

BEAR-RESISTANT PANNIER

This application claims the benefit of provisional application Ser. No. 60/425,909, filed Nov. 13, 2002.

BACKGROUND OF THE INVENTION

The present invention relates to a bear-resistant pannier having a latched cover which prevents a bear from opening the pannier.

Panniers are commonly used by horse packers to transport goods such as food items. In wilderness areas, bears in search for food often open a pannier in camp to reach the food items. This has created problems for persons using these panniers. As a result, the United States Forest Service requires back country campers to either use bear-resistant panniers or to rope the panniers in the air so that bears cannot reach the panniers.

The present invention is directed to a bear-resistant pannier which solves this problem by providing a spring-loaded latch which cannot be opened easily by bears.

Spring-loaded latches are known such as shown in U.S. Pat. No. 6,224,118 to Ashford for a "Child Resistant Latch System." The latch used with the present invention is designed to be used with a recessed cover and provides advantages over latches previously known.

SUMMARY OF INVENTION

A bear-resistant pannier including an open top pannier preferably constructed of metal with a recessed cover for covering the open top. A spring loaded latch selectively secures the recessed cover to the pannier.

DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
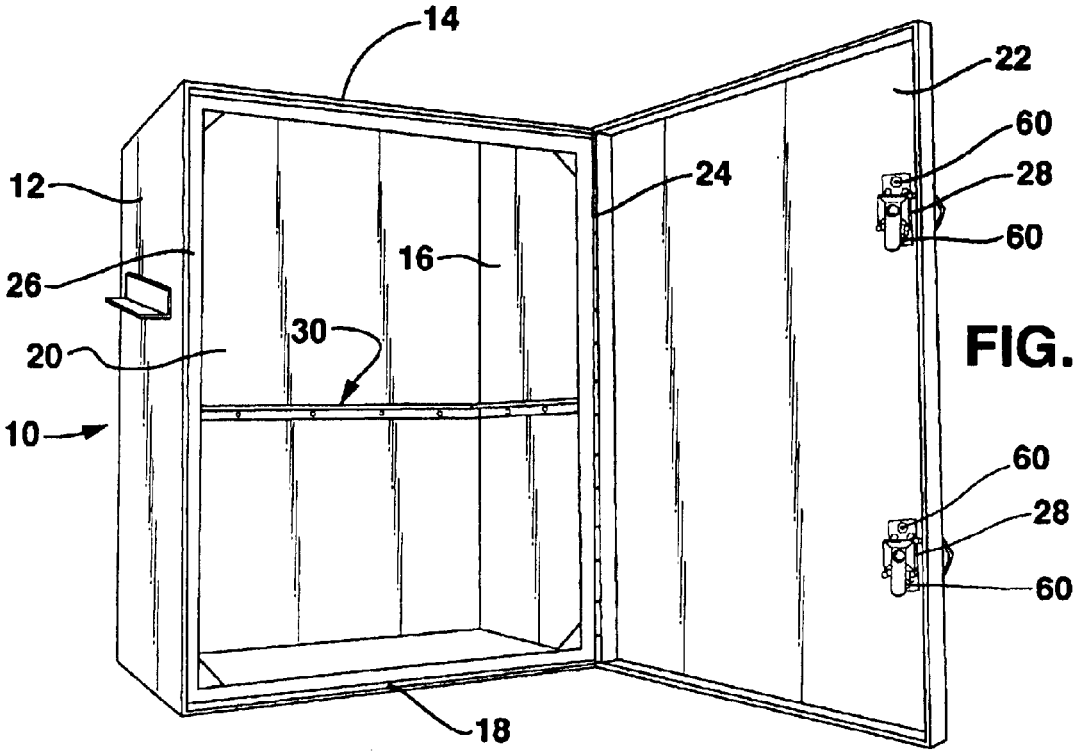
FIG. 1 is a front perspective view showing a bear-resistant pannier according to the present invention with a cover in an open position.

A bear-resistant pannier 10 is shown in FIG. 1. The bear-resistant pannier 10 includes a pannier box structure having four sidewalls 12, 14, 16 and 18, and a back wall 20. A cover 22, having a preselected thickness, is secured to sidewall 16 with a piano hinge 24. The sidewall 12 is provided with an interior extending lip 26. The lip 26 is positioned in spaced apart relation with respect to an outer edge of sidewall 12 corresponding to the thickness of the cover 22. Similarly, the other sidewalls are provided with an interior extending lip 26. With this arrangement, the cover 22 in the closed position is recessed within the sidewalls 12, 14, 16 and 18.

In a preferred embodiment, the pannier 10 is constructed of metal such as aluminum.

A pair of latches 28 are provided on the cover 22 for securing the cover 22 against the lip 26 of sidewall 12. The pannier 10 may also be provided with a shelf 30, as shown in FIG. 1.

Figure 2:
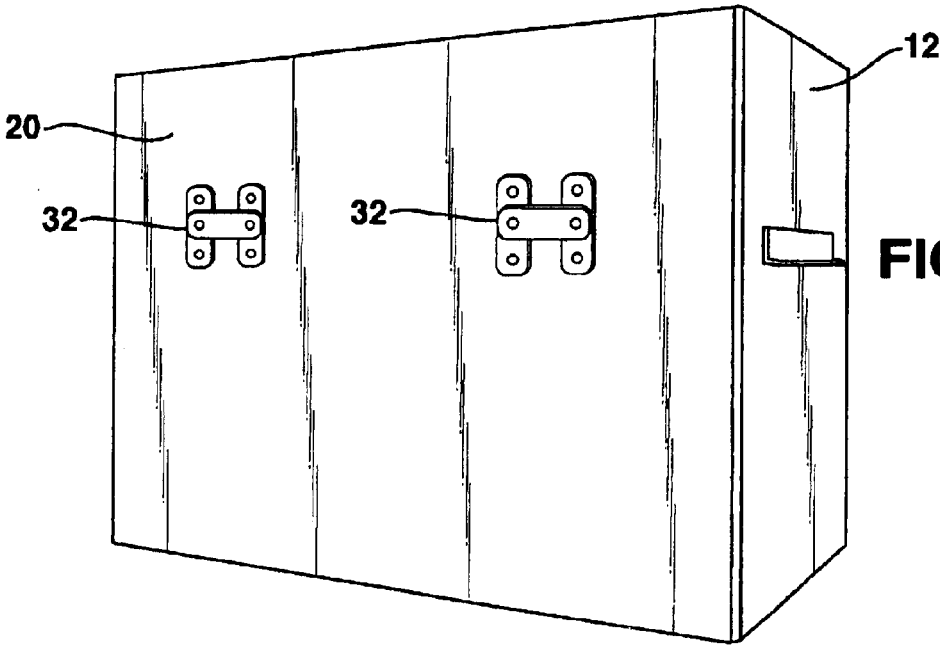
FIG. 2 is a rear perspective vies of the bear-resistant pannier shown in FIG. 1.

A rear view of the pannier 10 is shown in FIG. 2. The rear wall 20 is provided with a pair of mounting brackets 32 which can be used for strapping the pannier to a horse, for example.

Figure 3:
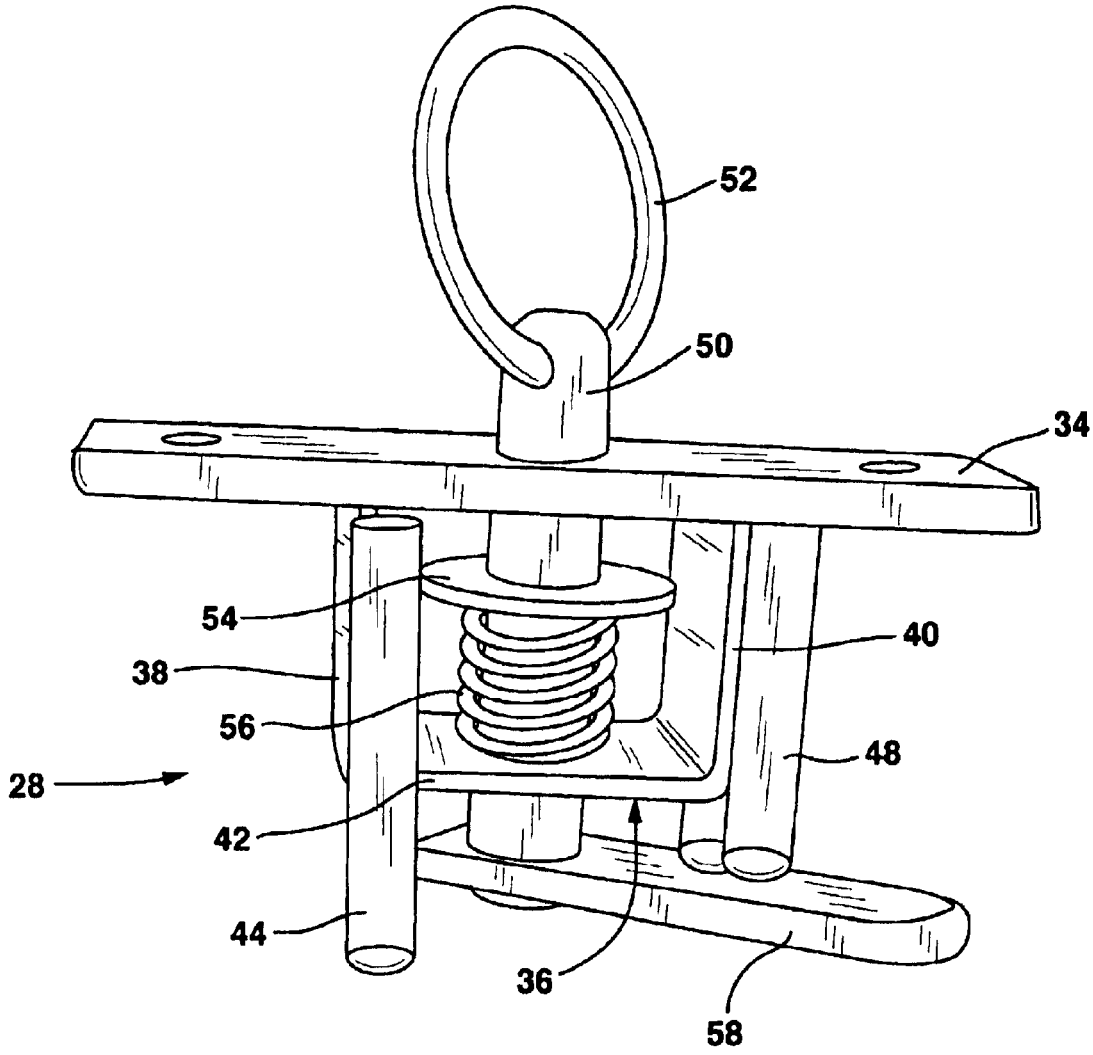
FIG. 3 is a front elevational view of a latch used with the present invention.
Figure 4:
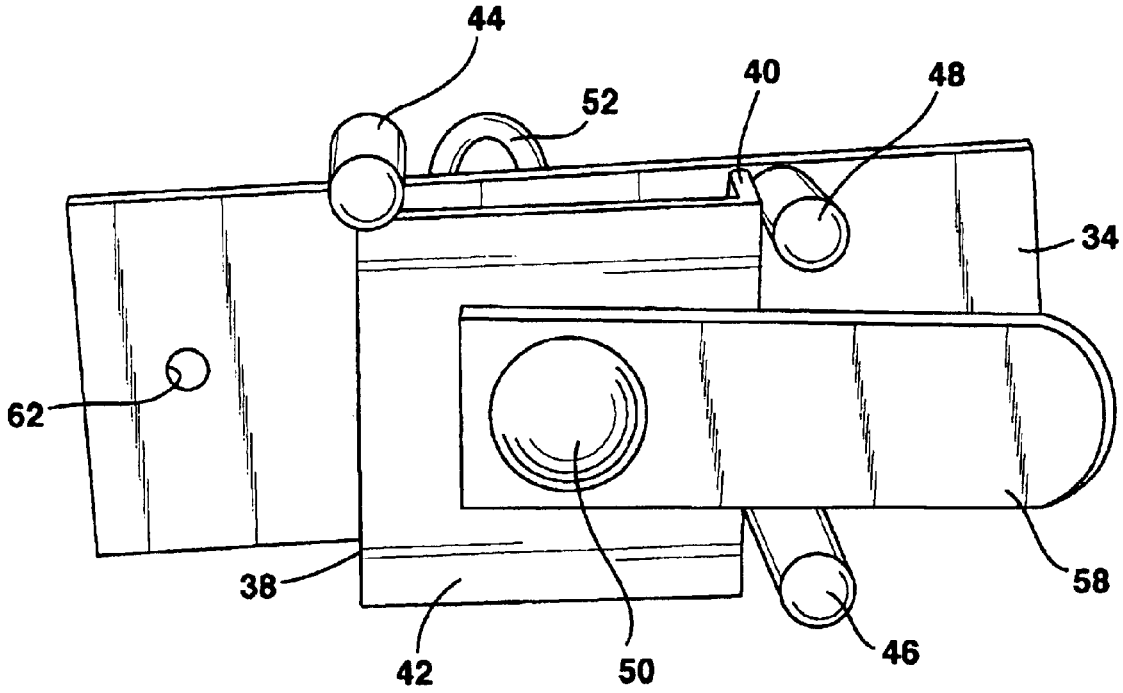
FIG. 4 is a bottom plan view of the latch shown in FIG. 3.

The latch 28 is shown in FIGS. 3–6. The latch 28 includes a mounting plate 34 and a squared "U"-shaped housing 36 which includes a pair of opposed legs 38 and 40 joined together by bottom member 42. The legs 38 and 40 are joined to the underside of mounting plate 34 as by welding. A post 44 is secured to an edge of leg 38, as by welding, as shown in FIGS. 3 and 4. Similarly, a post 46 is secured to an edge of leg 40, as by welding, as shown in FIG. 4. The posts 44 and 46 have the same length. A third post 48 is secured to an edge of leg 40, as by welding, as shown in FIGS. 3 and 4. The post 48 is of shorter length than posts 44 and 46.

The mounting plate 34 is provided with an opening extending into the space defined by the "U"-shaped housing 36. A rod 50 slidably extends through this hole in the mounting plate 34. A handle ring 52 is secured to an end of rod 50, as shown in FIG. 3. A washer 54 is positioned on the rod 50 within the interior of the "U"-shaped housing 36, and is welded thereto to prevent the rod 50 from being retracted through the corresponding hole in the mounting plate 34. A coil spring 56 is coiled around rod 50 between the washer 54 and the bottom member 42. The bottom member 42 is provided with a hole (not shown) aligned with the hole in mounting plate 34. The rod 50 extends through this hole. A latch plate 58 is secured to an end of rod 50, as by welding, as shown in FIGS. 3 and 4.

Figure 5:
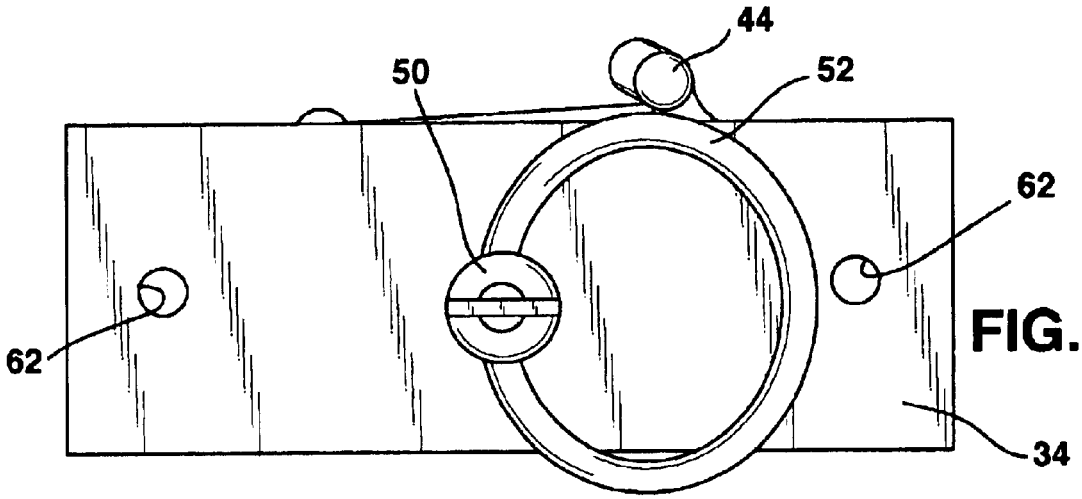
FIG. 5 is a top plan view of the latch shown in FIG. 3.
Figure 6:
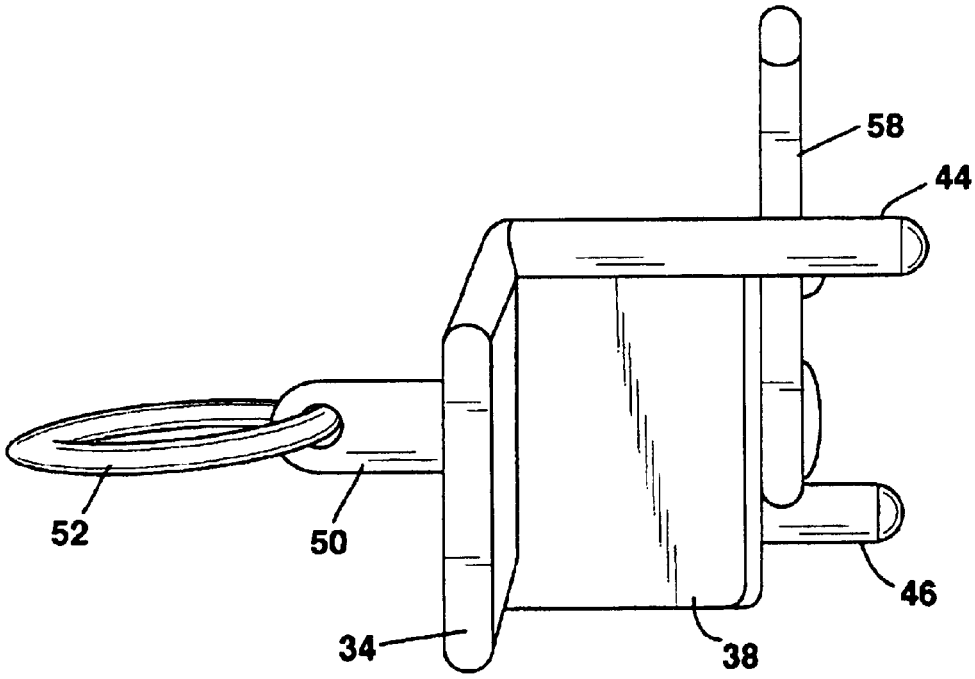
FIG. 6 is a left-side elevational view of the latch shown in FIG. 3.

Each mounting plate 34 of latch 28 is provided with a pair of holes 62, as shown in FIG. 5. The cover 22 of pannier 10 is provided with a corresponding set of holes (not shown). A pair of bolts and nuts 60 are used with the holes 62 and the corresponding holes in cover 12 to secure the mounting plate 34 of each latch 28 to the cover, as shown in FIGS. 1, 7, 8 and 9.

Figure 7:
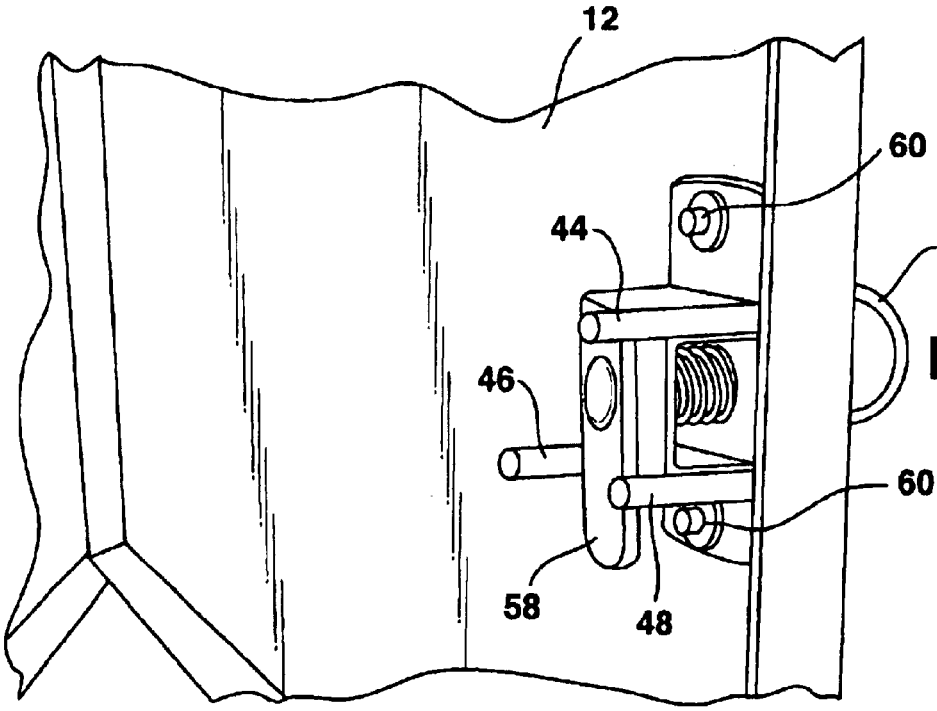
FIG. 7 is a view showing a latch mounted to a cover of the pannier with the latch in an open position.
Figure 8:
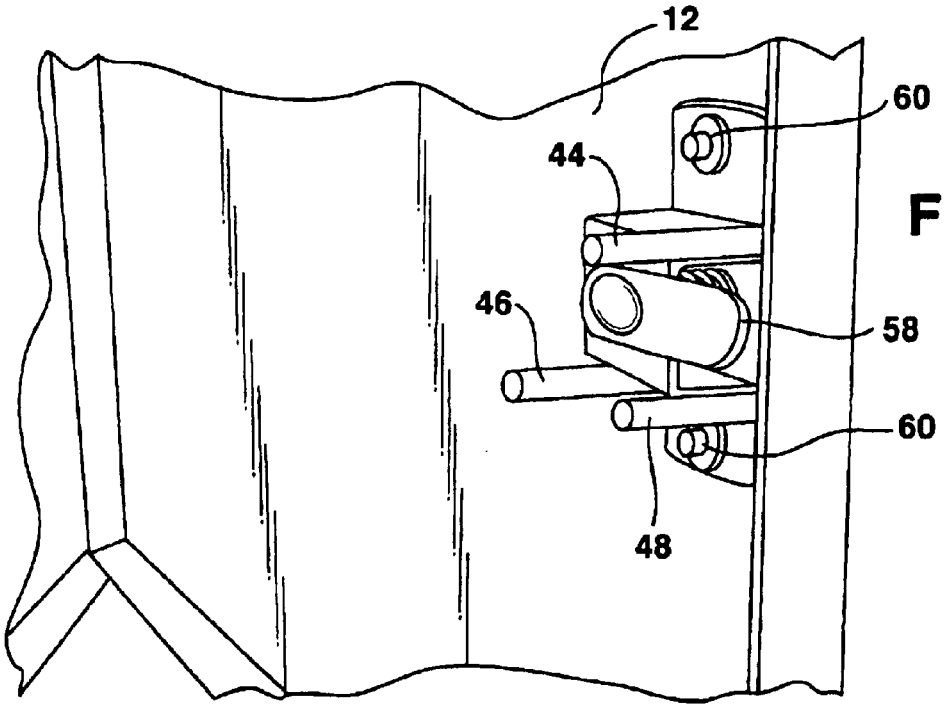
FIG. 8 is a view showing a latch mounted to a cover of the pannier with the latch in the closed position.
Figure 9:
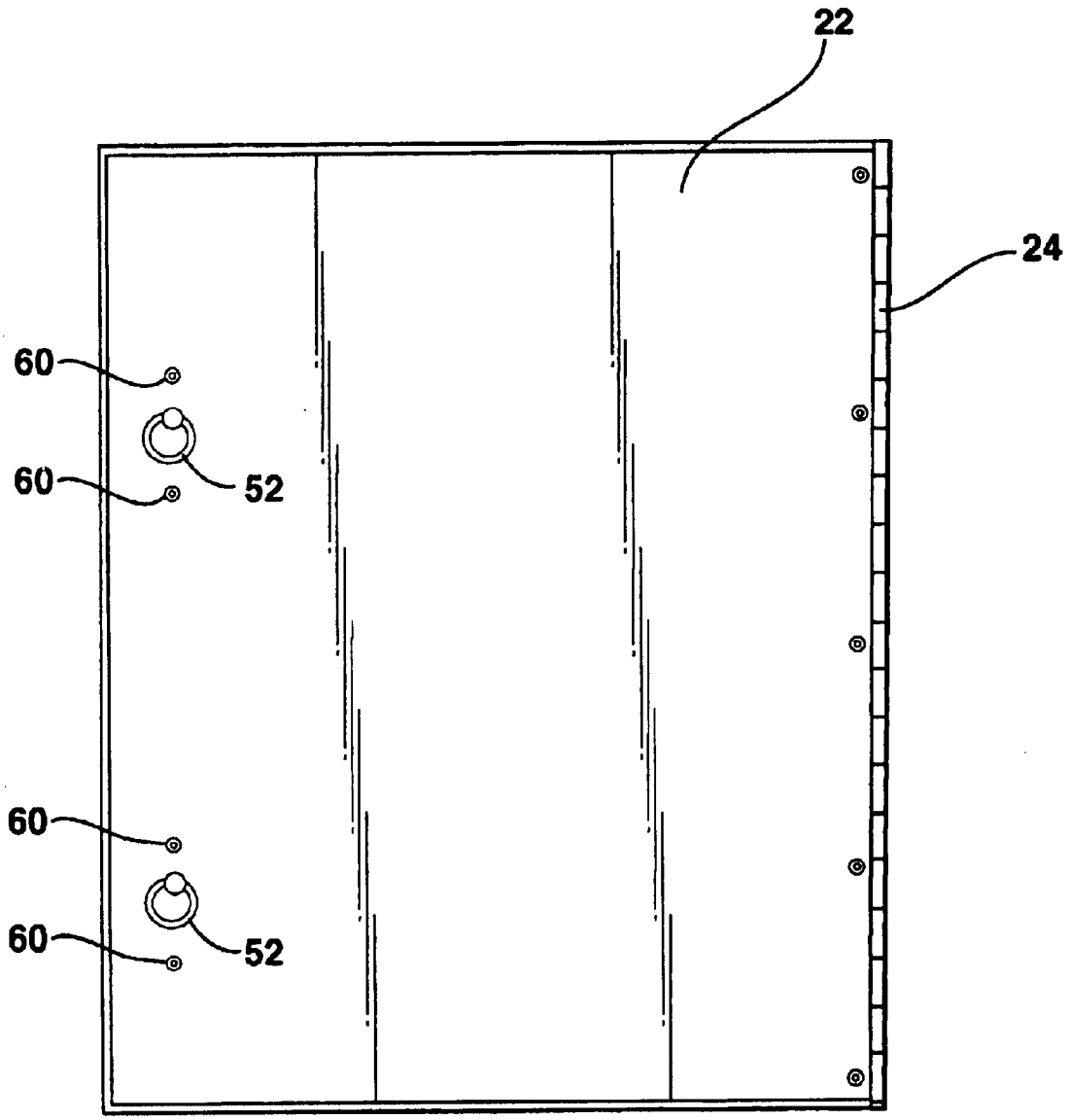
FIG. 9 is a front view of the bear-resistant pannier shown in FIG. 2 with the cover in a closed position.

In using the latch according to the present invention, the latch may be in an unlatched position, as shown in FIG. 7, with the latch plate 58 nesting between posts 46 and 48, as shown in FIGS. 4 and 7. The posts 46 and 48 prevent the latch plate 58 from rotating beyond the posts 46 and 48. The cover 22 is then closed with the cover 22 resting on lip 26 of the pannier. A user grasps the handle ring 52 and pushes the rod 50 inwardly compressing the spring 56, and then twists the rod 50 so that the latch plate 58 is positioned between the posts 44 and 48, passing over the top of post 48. The rod 50 is then released and the latch plate nests between posts 44 and 48. The posts 44 and 48 prevent the latch plate 58 from rotating beyond the posts 46 and 48. With the latch plate between posts 46 and 48 and the latch plate extending beneath the lip 26, the latch is in the latched position, as shown in FIG. 8. The latch plate prevents the cover 22 from pivoting outwardly away from sidewall 12. The latch 28, in the latched position, is shown in FIG. 8, and the pannier 10 with the latches in the latched position is shown in FIG. 9.

With this latch mechanism, it is difficult, if not impossible, for a bear to open the pannier. For a person to open the pannier, the handle ring 52 is again grasped and the rod 50 pushed inwardly and the rod 50 rotated until the latch plate 58 is between the rods 46 and 48, which is the open position. With the two latches in the open position, the cover 22 can be pivoted away from the sidewall 12 about the hinge 24.

While the fundamental novel features of the invention have been shown and described, it should be understood that various substitutions, modifications, and variations may be made by those skilled in the art, without departing from the spirit or scope of the invention. Accordingly, all such modifications or variations are included in the scope of the invention as defined by the following claims:

I claim:

1. A bear-resistant pannier comprising:

a pannier having an open top and having a bottom wall and four upright and joined sidewalls;

a cover means, having a thickness, for covering the open top of the pannier;

hinge means for hingedly mounting the cover means to a sidewall of the pannier;

the cover means movable from a closed position to an open position;

the four sidewalls having an interiorly extending lip positioned in spaced apart relation with the open top a distance corresponding to the thickness of the cover means;

the cover means provided with an opening adjacent an edge of the cover means opposite the hinge means;

a latch means mounted to the cover means and extending through the opening for selectively securing the cover means adjacent the lip of the sidewalls when the cover means is in the closed position;

the latch means comprising:

a mounting plate;

means for mounting the mounting plate to an outside surface of the cover means;

a squared "U"-shaped housing having a first and second opposed legs joined together by a bottom member;

free ends of the legs are joined to an underside of the mounting plate;

a first post secured to an edge of the first leg and extending in an interior direction away from the mounting plate for a distance beyond the bottom member;

a stop post secured to the second leg on the same side of the housing as the first post and extending in an interior direction away from the mounting plate to a distance beyond the bottom member;

a second post secured to an edge of the second leg on the opposite side of the housing as the stop post and extending in an interior direction away from the mounting plate to a distance beyond the bottom member;

the first and second posts having an identical length and the stop post having a length shorter than the first and second posts;

a rod having a length greater than the distance between the mounting plate and the bottom member;

the mounting plate having an opening extending into the space defined by the housing and sized to slidably receive the rod;

the rod positioned to extend through the opening in the mounting plate into the space defined by the housing;

a handle mounted to the rod at an end extending away from the mounting plate on a side opposite the housing;

the bottom member of the housing provided with a hole aligned with the opening in the mounting plate and sized to slidably receive the rod;

the rod positioned to extend through the opening in the bottom member and beyond the bottom member;

an elongate latch plate having one end affixed, in cantilever fashion, to an end of the rod extending beyond the bottom member;

the latch plate having a length greater than the distance of the rod to the interiorly extending lip of the pannier and rotatable from a latched position where a distal end of the latch plate extends below the lip of the pannier to an unlatched position where the distal end of the latch plate is free from the lip of the pannier;

a washer affixed to the rod between the mounting plate and the bottom member; and a coil compression spring positioned on the rod between the washer and the bottom member;

the coil spring being partially compressed between the washer and the bottom spring member to resiliently bias the latch plate against the bottom member;

the handle operable to urge the rod against the bias force of the coil spring to move the latch plate beyond the free end of the stop post;

the handle further operable to rotate the latch plate to a position where the latch plate may nest either between the first post and the stop post or between the second post and the stop post.

2. The pannier according to claim 1 wherein the bottom wall, four upright sidewalls and cover means are constructed of metal.

3. The pannier according to claim 1 wherein a pair of mounting brackets are mounted to an exterior surface of the bottom wall for use in strapping the pannier to a horse.

4. The pannier according to claim 1 wherein a shelf is mounted within the interior of the pannier.

5. A latch for latching a cover to an interiorly extending latching lip of an open top pannier comprising:

a mounting plate;

means for mounting the mounting plate to an outside surface of the cover adjacent the latching lip of the pannier;

a squared "U"-shaped housing having a first and second opposed legs joined together by a bottom member;

free ends of the legs are joined to an underside of the mounting plate;

a first post secured to an edge of the first leg and extending in an interior direction away from the mounting plate for a distance beyond the bottom member;

a stop post secured to the second leg on the same side of the housing as the first post and extending in an interior direction away from the mounting plate to a distance beyond the bottom member;

a second post secured to an edge of the second leg on the opposite side of the housing as the stop post and extending in an interior direction away from the mounting plate to a distance beyond the bottom member;

the first and second posts having an identical length and the stop post having a length shorter than the first and second posts;

a rod having a length greater than the distance between the mounting plate and the bottom member;

the mounting plate having an opening extending into the space defined by the housing and sized to slidably receive the rod;

the rod positioned to extend through the opening in the mounting plate into the space defined by the housing;

a handle mounted to the rod at an end extending away from the mounting plate on a side opposite the housing;

the bottom member of the housing provided with a hole aligned with the opening in the mounting plate and sized to slidably receive the rod;

the rod positioned to extend through the hole in the bottom member and beyond the bottom member;

an elongate latch plate having one end affixed, in cantilever fashion, to an end of the rod extending beyond the bottom member;

the latch plate having a length greater than the distance of the rod to the latching lip of the pannier and rotatable from a latched position where a distal end of the latch plate extends below the latching lip of the pannier to an unlatched position where the distal end of the latch plate is free from the latching lip of the pannier;

a washer affixed to the rod between the mounting plate and the bottom member; and a coil compression spring positioned on the rod between the washer and the bottom member;

the coil spring being partially compressed between the washer and the bottom member to resiliently bias the latch plate against the bottom member;

the handle operable to urge the rod against the bias force of the coil spring to move the latch plate beyond the free end of the stop post;

the handle further operable to rotate the latch plate to a position where the latch plate may nest either between the first post and the stop post or between the second post and the stop post.

* * * * *